US005192127A

United States Patent [19]

Schaef

[11] Patent Number: 5,192,127

[45] Date of Patent: Mar. 9, 1993

[54] TWO-PIECE LOCKING LAMP FIXTURE

[75] Inventor: Irving W. Schaef, Hialeah, Fla.

[73] Assignee: GKI, Miami, Fla.

[21] Appl. No.: 835,796

[22] Filed: Feb. 14, 1992

[51] Int. Cl.[5] ..... H01R 33/00

[52] U.S. Cl. ..... 362/226; 362/806; 439/278; 439/282

[58] Field of Search ..... 362/226, 227, 249, 123, 362/252, 806; 439/278, 282, 345

[56] References Cited

U.S. PATENT DOCUMENTS 4,704,669 11/1987 Brunner ..... 362/226 X 5,013,960 5/1991 Tseng ..... 362/226 X

*Primary Examiner*—Allen M. Ostrager

*Attorney, Agent, or Firm*—Collard & Roe

[57] ABSTRACT

The present invention relates to a retaining structure for removably connecting and maintaining electrical engagement between a light bulb and more particularly, a lamp base portion thereof, with an electrically wired socket. The squeezing of the socket wall changes the dimensions and shape of these walls that allows the releasing of mated protrusions on opposite parts to permit the removal of the lamp base from the socket.

21 Claims, 6 Drawing Sheets

TWO-PIECE LOCKING LAMP FIXTURE

BACKGROUND OF THE INVENTION

1. Field of the Invention

The present invention relates to a retaining structure for removably connecting and maintaining electrical engagement between a light bulb and more particularly, a lamp base portion thereof with an electrically wired socket. The squeezing socket wall changes the dimensions and shape of these walls that allows the releasing of mated protrusions on opposite parts, to permit the removal of the lamp base from the socket.

2. The Prior Art

It is known to provide a latching structure designed to removably maintain a light bulb and base portion thereof within an electrical socket which is wired for providing electrical current to the light bulb for activation thereof.

The Livermore U.S. Pat. No. 4,318,158 discloses a bulb holder assembly including a mounting carrying a coupling toward one end whereby the one end can be inserted into an aperture in a supporting wall and secured therein. The bulb holder assembly includes a bulb holder removably mounted in the end of the mounting with the coupling. The bulb holder is capable of being inserted into the aperture with the mounting as a unit from one side of the supporting wall to project through the aperture for removal from the mounting from the other side of the supporting wall. As a result, in order to change a faulty or used bulb, the holder can be removed from the rear of the supporting wall by withdrawing the holder from the mounting or, alternatively, the mounting can be disconnected from the front of the aperture and the holder detached from the mounting. Thus, a bulb can be changed from the front or the rear.

The Van Sickler U.S. Pat. No. 4,679,126 discloses a decorative string set used for Christmas lighting. The string set comprises various embodiments of clamping means which provide positive retention of incandescent lamps to their respective electrical sockets.

The Kelner U.S. Pat. No. 4,803,396 discloses a light bulb assembly composed of (a) a light bulb and a base in electrical engagement in (b) a wired plug and (c) a keeper to keep the assembly together; the keeper includes a cap with an opening in the upper surface for passage of the bulb and with the axial face of the cap in engagement with the axial face of the bulb base, and not the bulb, and with the annular portion of the cap having a portion on it for normal hooked-up engagement with a companionate portion on the plug to keep the light bulb in electrical engagement with the wired plug in normal use.

The Schaef U.S. Pat. No. 5,013,258 discloses a bulb in a base that fits within a socket. The base has a flange and the socket has a flange, such that these flanges contact each other whenever the base is inserted into the socket. There is a connector means generally in the form of an exteriorly mounted collar type structure that fits over these flanges when in contact with each other.

SUMMARY OF THE INVENTION

While the present invention is described hereinafter in greater detail with specific reference to use of the subject assembly on miniature lighting assemblies of the decorative type, such structure could be adapted for use on light bulbs and accompanying sockets of varying dimensions and configurations and still be within the intended scope of the present invention.

The present invention therefore relates to the combination of electric light bulbs having a substantially conventionally configured or structured filament and an electrical connector means attached thereto. The electrical connector may be formed on the base which is specifically dimensioned and configured to fit within the interior portions of an electrical socket. The socket is of course wired by conventional electrical conductors to a source of electrical power such that current is delivered to the base when it is snugly disposed in its operative position within the socket.

The present invention is directed to an improved lamp retention assembly that relies upon a locking and an unlocking interaction of protrusions on opposite faces of mating parts, namely, the walls of the lamp base and the wall of the socket. There is a unique releasing mechanism that is based upon having a compressive force applied to these exterior walls that reshapes these mating parts from circular to elliptical and then from elliptical back to circular. The change in shape extends the protrusions on one wall beyond their opposite mating part on the other wall. This requires a cavity to be present between the outside and inside walls to permit an inward flexing when a compressive squeezing force is applied to the outside wall. This permits removal of the lamp base from the socket.

To accomplish this, the wall thickness of the outside wall which is to be inwardly flexed is reduced slightly and sufficiently to allow for greater flexibility. There is a very definite proportional relationship between the length and thickness of the wall to which the force is applied. The longer and thinner the wall, the more the wall will flex and become more elliptical, when a compressive, inwardly-directed force is exerted thereto.

Generally speaking, the invention is directed to the squeezing of the socket walls to change the dimensions and shape of these walls that allows the releasing of mated protrusions on opposite parts, to permit the removal of the lamp base from the socket.

One embodiment utilizes a lamp base with an extended top portion that encases the top portion of the socket and latches onto protrusions on the socket exterior wall.

A preferred embodiment utilizes protrusions on the outside wall of the lamp base and on the inside wall of the socket. A cavity that is created between these two walls is sufficient to allow for ample flexing when a compressive force is applied to the outside wall of the socket.

For the interior latching, there is provided a compression cavity, which is the area between the exterior wall of the lamp base and the interior wall of the socket in the upper portion which allows the flexing inwardly of the socket wall.

There are vertical stabilizers located on the top portion of the lamp base exterior wall. These vertical extrusions or stabilizers prevent lateral movement of the lamp base when inserted into the socket. Located at 45 degrees to each other, they do not diminish the compression cavity mentioned above and, in fact, can be utilized to change the flexing of the exterior wall of the socket.

In a further embodiment, the lamp base includes bulb retainer ribs or non-twist elements which are two or more protrusions on the bottom and inside of the interior walls of the lamp base that prevents a bulb from twisting or rotating within the lamp base.

Also, in another embodiment, the protrusion at the top of the socket can be squared off as well as rounded.

An additional embodiment utilizes a elongated shaped lamp base and socket to facilitate a snapping effect at the locking insertion and the unlocking removal.

The present invention, generally speaking, is directed to a locking lamp fixture comprising a lamp base for containing a light bulb, a socket for holding this lamp base, the lamp base cooperatively dimensioned and configured to fit within the socket such that there is a spaced distance between the lamp base and the socket, latch means on the lamp base for extending across the spaced distance toward the socket, catch means on the socket for extending across the spaced distance for mating engagement with the latch means on the lamp bases, and disconnection means capable of reshaping the spaced distance, whenever a sufficient force is applied to the disconnection means, to permit the catch means to disengage from the latch means to terminate the mating engagement thereof.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 10:
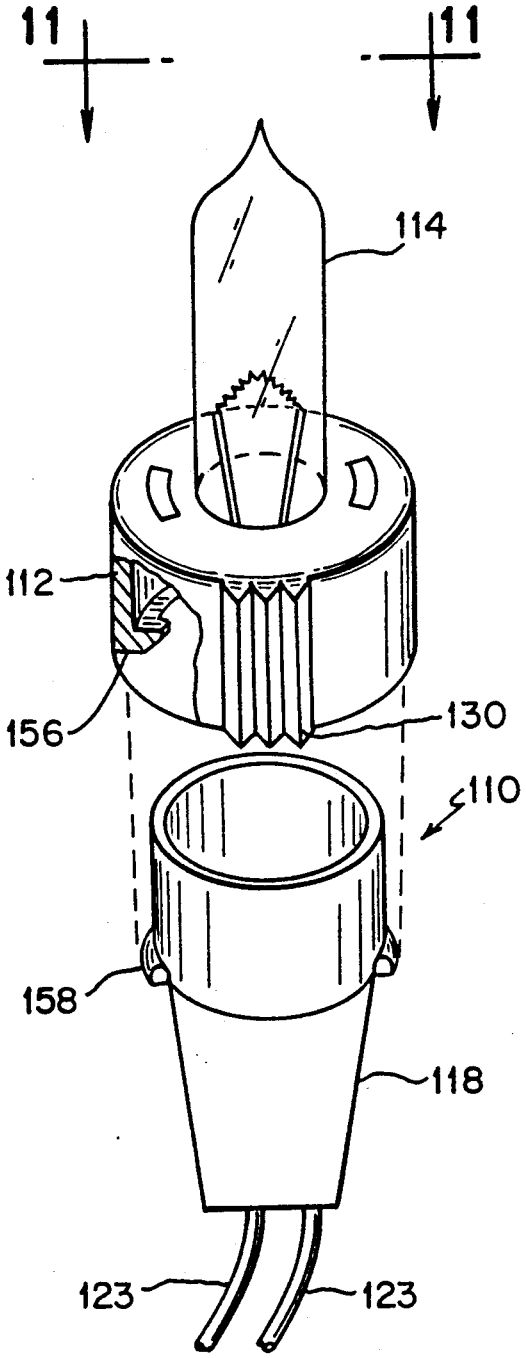
FIG. 10 is an exploded plan view of a second embodiment of the locking lamp fixture, wherein the lamp base is unlocked and withdrawn from the socket
Figure 1:
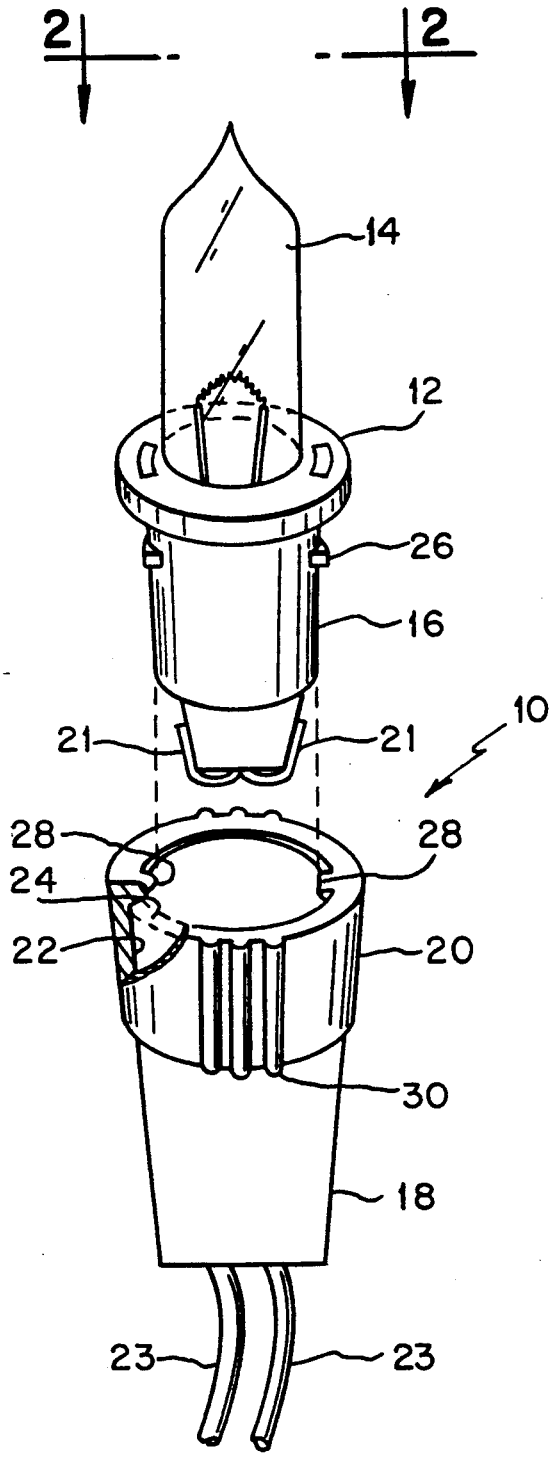
FIG. 1 is an exploded plan view of a preferred embodiment of the locking lamp fixture wherein the lamp base is unlocked and withdrawn from the socket.

Turning now in detail to the drawings, FIGS. 1 to 4 show a preferred embodiment in which a locking lamp fixture 10 comprises a lamp base 12 for containing a light bulb 14. The lamp base 12 has an exterior wall 16. There is a socket 18 for holding the lamp base, with the socket 18 having an exterior wall 20 and having an interior wall 22. The lamp base is cooperatively dimensioned and configured to fit and to be locked within the socket, such that there is a spaced distance 24 between the exterior wall 16 of the lamp base and the interior wall 22 of the socket. A latch means 26 on the lamp base 12 exterior wall 16 extends across the spaced distance 24 toward the interior wall 22 of the socket. There is a catch means 28 on the socket interior wall for extending across the spaced distance 24 for mating engagement with the latch means 26 on the lamp base.

Figure 3:
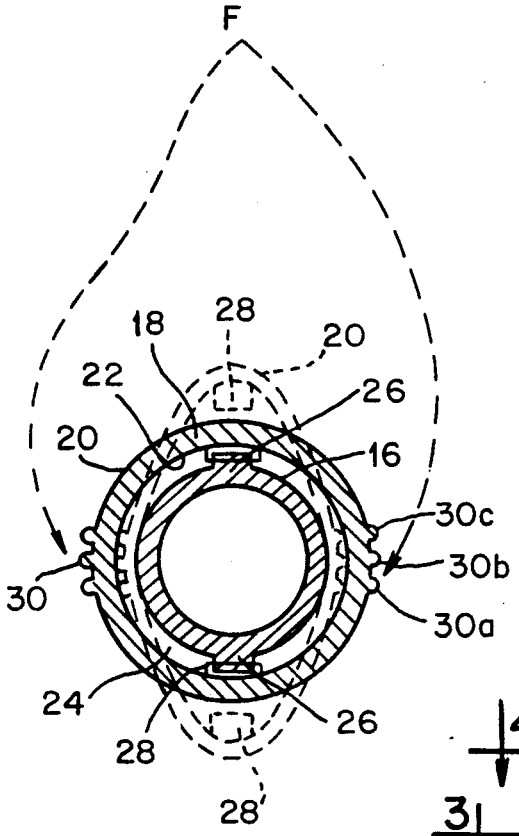
FIG. 3 is a section view of the locking lamp fixture along line 3—3 of FIG. 2, and also showing the disconnection means reshaping the spaced distance.

A disconnection means 30 is located on the exterior wall 20 of the socket 18 capable of reshaping the socket exterior wall 20, whenever a sufficient compressive or squeezing force F (FIG. 3) is applied to the disconnection means 30 of the socket exterior wall 20. This will cause inward flexing of the socket exterior wall to reshape the exterior wall 20 and the spaced distance 24 from circular to elliptical, as shown in phantom lines in FIG. 3. This will permit catch means 28 to disengage and unlock from latch means 26 to terminate the mating engagement of these wall parts in order to release the lamp base to permit the removal thereof, as shown in FIG. 3.

Figure 2:
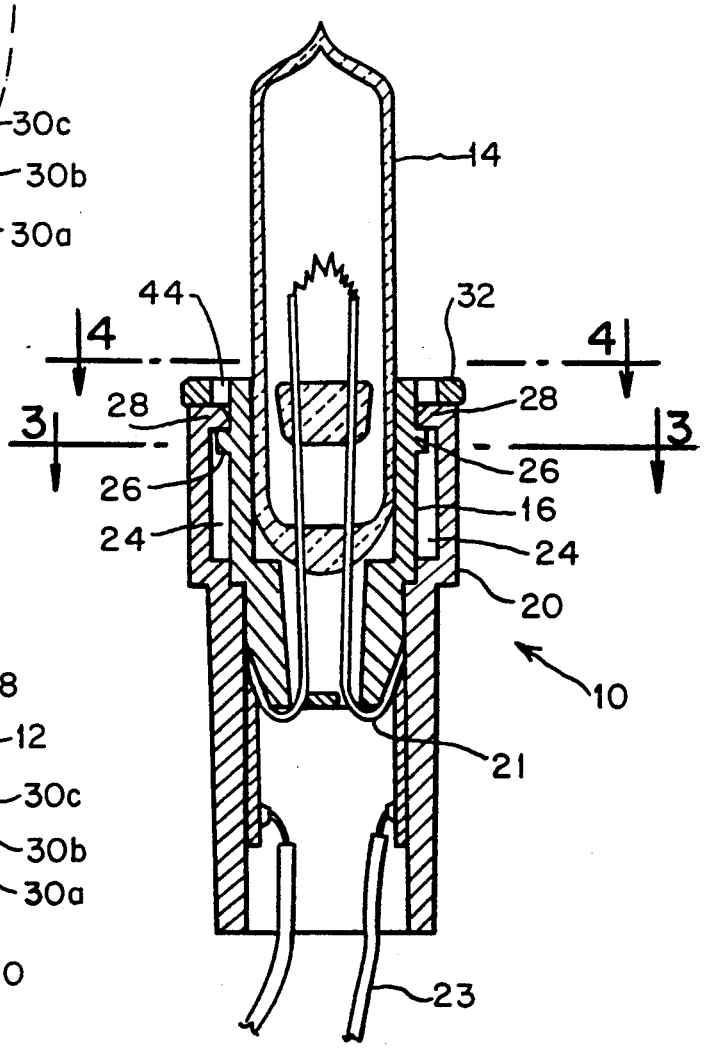
FIG. 2 is a section view of the locking lamp fixture along line 2—2 of FIG. 1 showing the lamp base locked into position within the socket.
Figure 4:
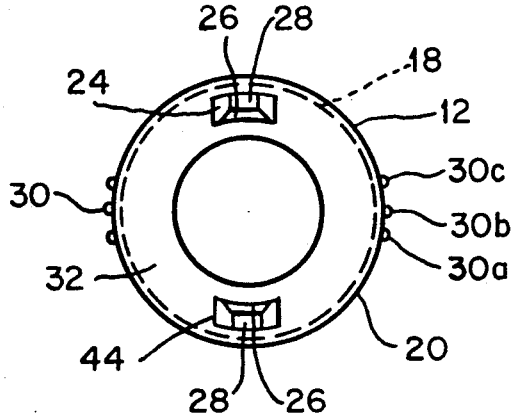
FIG. 4 is a top view of the locking lamp fixture along line 4—4 of FIG. 2.
Figure 5:
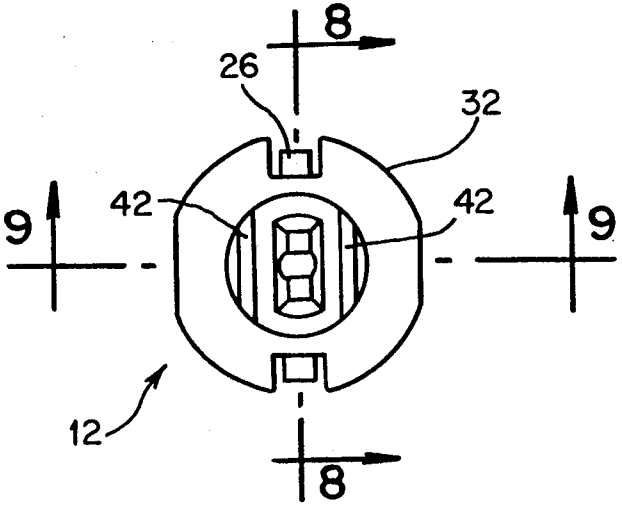
FIG. 5 is a top view of another embodiment of the lamp base.
Figure 6:
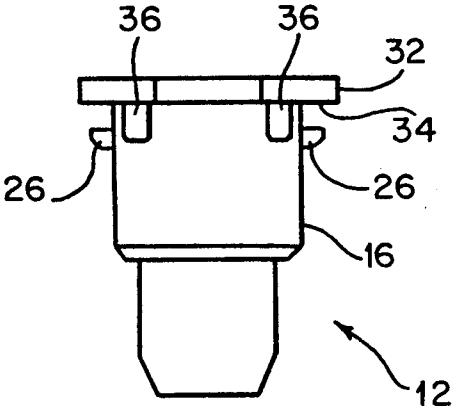
FIG. 6 is a right-side view of the lamp base of FIG. 5.
Figure 7:
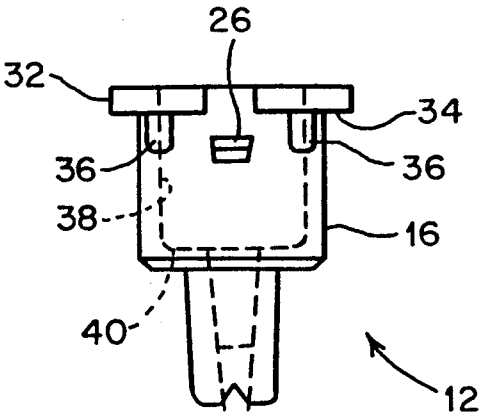
FIG. 7 is a front view of the lamp base of FIG. 5.
Figure 8:
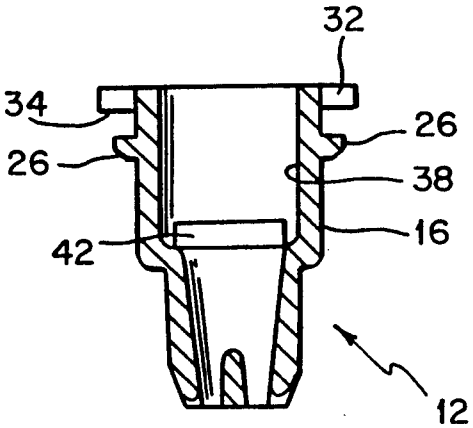
FIG. 8 is a section view of the lamp base along 8—8 of FIG. 5.
Figure 9:
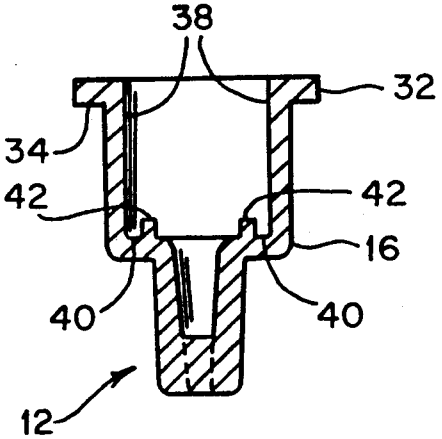
FIG. 9 is a section view of the lamp base along line 9—9 of FIG. 5.
Figure 12:
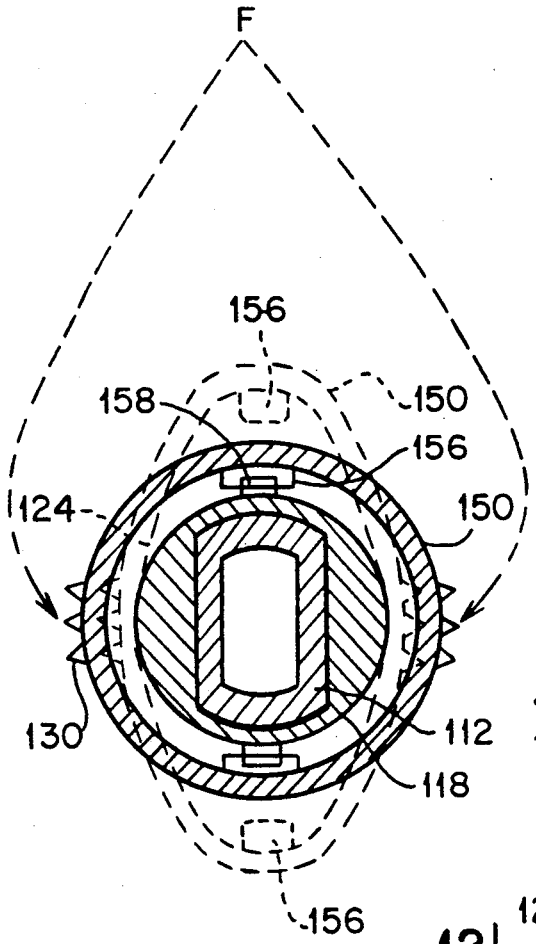
FIG. 12 is a section view of the locking lamp fixture along line 12—12 of FIG. 11, and also showing the connection means reshaping the spaced distance.
Figure 11:
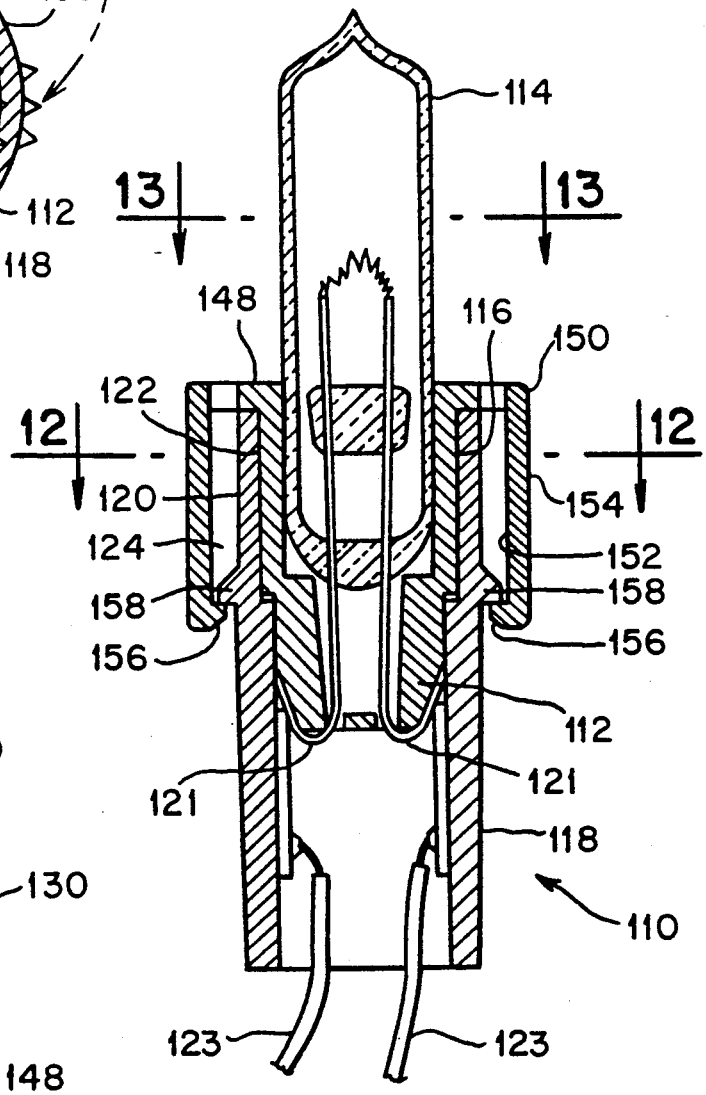
FIG. 11 is a section view of the locking lamp fixture along line 11—11 of FIG. 10, showing the lamp base locked into position within the socket.
Figure 13:
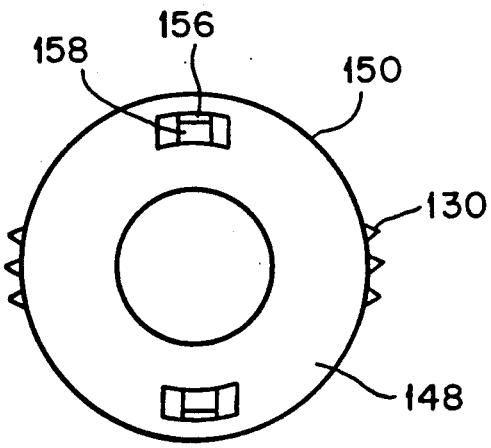
FIG. 13 is a top view of the locking lamp fixture of FIG. 11.
Figure 16:
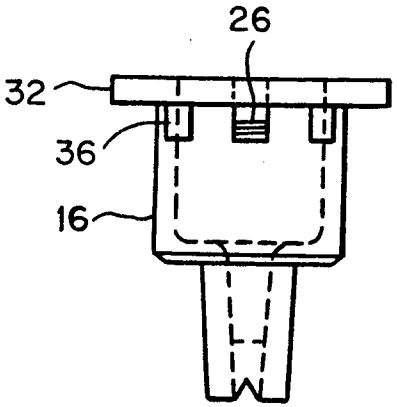
FIG. 16 is a front view of the lamp base of FIG. 15.
Figure 15:
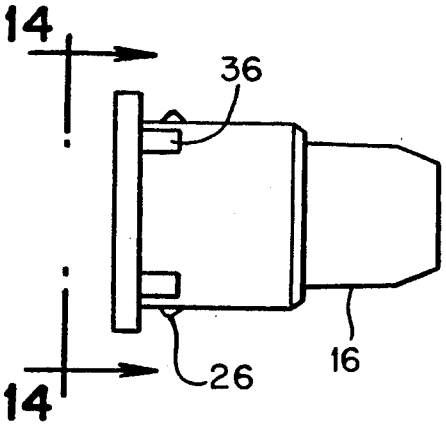
FIG. 15 is a side view of a further embodiment of the lamp base according to the present invention.
Figure 18:
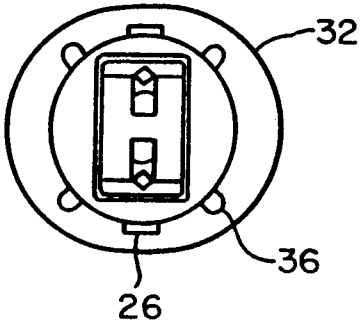
FIG. 18 is a bottom view of the lamp base of FIG. 16.
Figure 17:
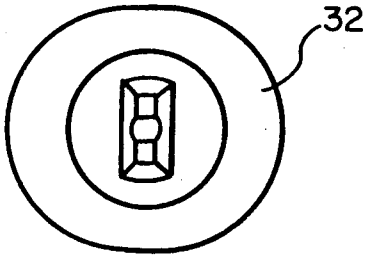
FIG. 17 is a top view of the lamp base of FIG. 16.
Figure 14:
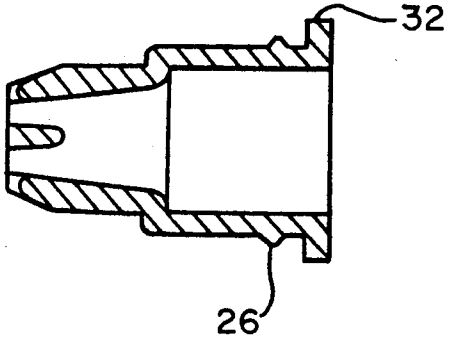
FIG. 14 is a cross-section view of a further embodiment of the lamp base along line 14—14 of FIG. 15.
Figure 20:
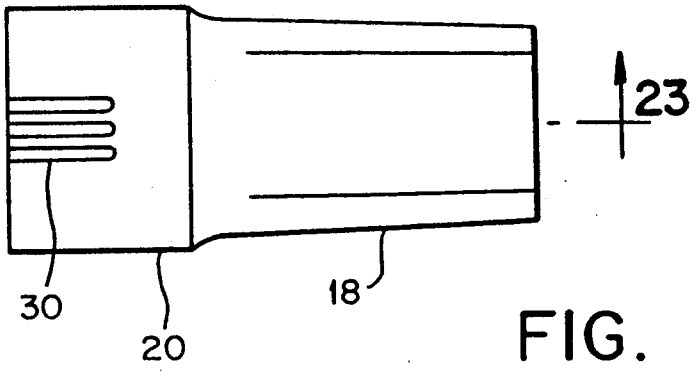
FIG. 20 is a side view of a further embodiment of the socket according to the present invention.
Figure 23:
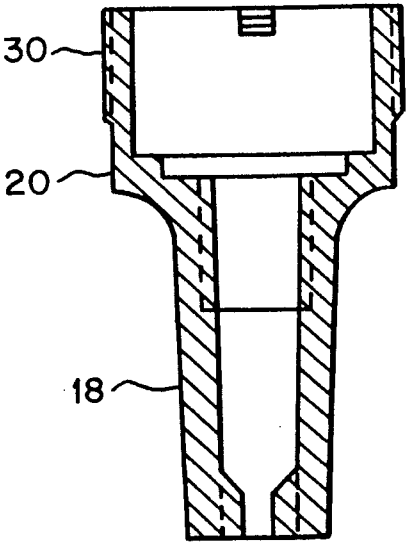
FIG. 23 is a cross-section view of the socket along line 23—23 of FIG. 20.
Figure 22:
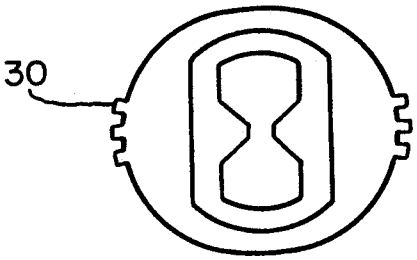
FIG. 22 is a left side view of the socket of FIG. 20.
Figure 19:
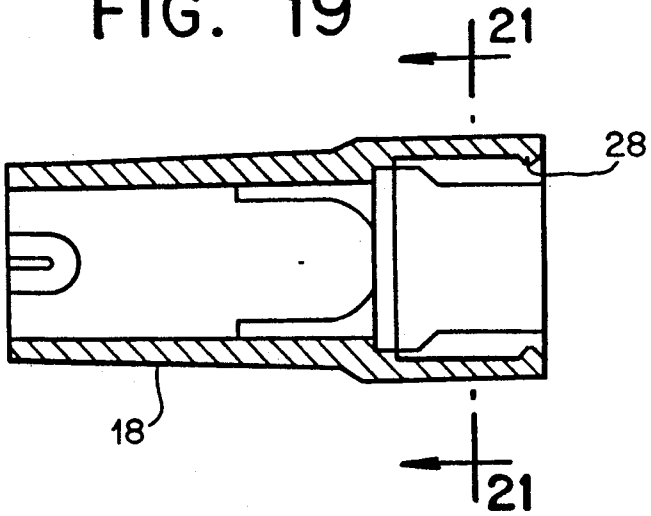
FIG. 19 is a cross-section view of a further embodiment of the socket along line 19—19 of FIG. 20.
Figure 21:
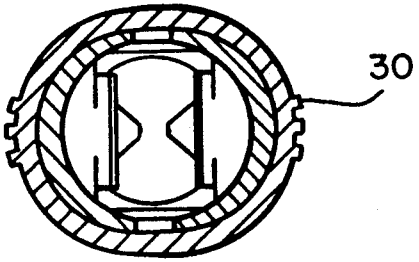
FIG. 21 is a cross-section view of the socket along line 21—21 of FIG. 19.

FIG. 2 shows the lamp base locked within the socket due to having the socket catch 28 gripped on one side by the lamp base latch 26 and gripped by the lamp base top 32 on the other side of the socket catch.

Conventional electrical lead wires 21 are fitted into the lamp base and connect the bulb 14 with the lead wires 23 fitted into the socket, which are connected to an external power source.

In the locking lamp fixture 10, the latch means 26 comprises a protrusion on the lamp base, and the catch means 28 comprises a protrusion on the socket. The reshaping of the spaced distance 24 enables these protrusions to extend beyond each's respective opposite mating part to permit the disengaging thereof.

In the locking lamp fixture 10, the latch means 26 and the catch means 28 are aligned for the mating engagement therewith. The disconnection means 30 comprises a series of projections **30*a*, 30*b* and 30*c* which are a set distance apart along the circumference of external wall 20. Means 30 is about 90° out of alignment with the aligned latch means and catch means. There is a viewing port opening 44 in top 32** through which the user can observe that the latch means and the catch means are properly aligned.

While it is possible for the latch means and for the catch means to extend around the complete circumferential perimeter of the lamp base or socket, respectively, it is also possible for them to extend partly around the perimeter, as shown in the drawings.

In the locking lamp fixture of FIGS. 10–13, the lamp base can have a wall thickness which is reduced slightly in order to allow for greater flexibility relative to the socket which can have a greater wall thickness than the lamp base.

In the locking lamp fixture of FIGS. 1 to 4, the disconnection means 30 is positioned on the socket 18, and this socket has a wall thickness which is reduced slightly in order to allow for greater flexibility relative to the lamp base 12, which has a greater wall thickness than the socket.

As shown in FIGS. 5–9, the locking lamp fixture has a lamp base 12 with an exterior wall 16 having a top portion 32, with an underside 34. Vertical stabilizers 36 are located on the underside 34 of top portion 32 of the lamp base exterior wall to prevent lateral movement of the lamp base when inserted into the socket.

As also shown in FIGS. 5–9, the locking lamp fixture has a lamp base 12 with an inside wall 38 having a bottom portion 40. Bulb retainer ribs 42 are located on this bottom portion 40 of the inside wall 38 of the lamp base for preventing a lamp bulb from twisting or rotating when placed within the lamp base 12.

In a second embodiment as shown in FIGS. 10–13, the locking lamp fixture 110 comprises a lamp base 112 for containing a light bulb 114. The lamp base 112 has an exterior wall 116 and has a top end 148 with a top extended portion 150. The top extended portion 150 has an internal surface 152 and an external surface 154. There is a socket 118 for holding the lamp base 112. This socket 118 has an exterior wall 120 and has an interior wall 122. The lamp base is cooperatively dimensioned and configured to fit and to be locked within the socket, such that the exterior wall 116 of the lamp base 112 contacts the interior wall 122 of the socket 118 and such that there is a spaced distance 124 between the exterior wall 120 of the socket 118 and the internal surface 152 of the top extended portion 150. Latch means 156 on the internal surface 152 of the top extended portion of the lamp base extends across the spaced distance 124 toward the exterior wall 120 of the socket. Catch means 158 on the socket exterior wall 120 extends across said spaced distance 124 and is aligned with the latch means for mating engagement with the latch means 156 on the lamp base.

There is a disconnection means 130 located on the external surface 154 of the top extended portion 150 of the lamp base capable of reshaping the external surface 154, whenever a compressive or squeezing force F (FIG. 12) is applied to the disconnection means 130 on the external surface 154. This will cause inward flexing of the top extended portion to reshape the top portion 150 and the spaced distance 124 from circular to elliptical, as shown in phantom lines in FIG. 12. This will permit the catch means 158 to disengage and unlock from the latch means 156 to terminate the mating engagement of these wall parts in order to release the lamp base to permit the removal thereof, as shown in FIG. 10.

Conventional electrical lead wires 121 are fitted into the lamp base and connect the bulb 114 with the lead wires 123 fitted into the socket, which are connected to an external power source.

A further embodiment of the invention is shown in FIGS. 14 to 23. Here, FIGS. 14 to 18 show an elongated-shaped lamp base, while FIGS. 19 to 23 show an elongated-shaped socket. This structure facilitates a snapping effect during the locking insertion of the lamp base into the socket, and an unlocking removal of the lamp base from the socket.

While several embodiments of the present invention have been shown and described, it is to be understood that many changes and modifications may be made thereunto without departing from the spirit and scope of the invention as defined in the appended claims.

What is claimed is:

1. A locking lamp fixture comprising a lamp base for containing a light bulb;

a socket for holding said lamp base;

said lamp base cooperatively dimensioned and configured to fit within said socket such that there is a spaced distance between said lamp base and said socket latch means on said lamp base for extending across said spaced distance toward said socket;

catch means on said socket for extending across said spaced distance for mating engagement with said latch means on said lamp base; and disconnection means capable of reshaping said spaced distance, whenever a sufficient force is applied to said disconnection means, to permit said catch means to disengage from said latch means to terminate said mating engagement thereof.

2. The locking lamp fixture of claim 1, wherein said spaced distance is initially circular; and wherein said spaced distance is reshaped to be elliptical whenever a sufficient force is applied.

3. The locking lamp fixture of claim 2, wherein said latch means comprises a protrusion of said lamp base;

wherein said catch means comprises a protrusion on said socket; and wherein said reshaping of said spaced distance enables said protrusions to extend beyond each's respective opposite mating part to permit said disengaging thereof.

4. The locking lamp fixture of claim 1, wherein said latch means and said catch means are aligned; and wherein said disconnection means is about 90° out of alignment with said aligned latch means and catch means.

5. The locking lamp fixture of claim 1, wherein said disconnection means is positioned on said lamp base; and wherein said lamp base has a wall thickness which is reduced slightly in order to allow for greater flexibility relative to said socket which has a greater wall thickness.

6. The locking lamp fixture of claim 1, wherein said disconnection means is positioned on said socket; and wherein said socket has a wall thickness which is reduced slightly in order to allow for greater flexibility relative to said lamp base which has a greater wall thickness.

7. The locking lamp fixture of claim 1, wherein the lamp base has an exterior wall having a top portion with an underside; and vertical stabilizers located on said underside of said top portion of said lamp base exterior wall to prevent lateral movement of the lamp base when inserted into the socket.

8. The locking lamp fixture of claim 1, wherein the lamp base has an inside wall having a bottom portion; and bulb retention ribs located on said bottom portion of the inside wall of the lamp base for preventing a lamp bulb from twisting or rotating in said lamp base.

9. A locking lamp fixture comprising a lamp base for containing a light bulb; said lamp base having an exterior wall;

a socket for holding said lamp base; said socket having an exterior wall and having an interior wall;

said lamp base cooperatively dimensioned and configured to fit within said socket such that there is a spaced distance between said exterior wall of said lamp base and said interior wall of said socket;

latch means on said lamp base exterior wall for extending across said spaced distance toward said interior wall of said socket;

catch means on said socket interior wall for extending across said spaced distance for mating engagement with said latch means on said lamp base; and disconnection means on the exterior wall of said socket capable of reshaping said socket interior wall, whenever a sufficient force is applied to said disconnection means of said socket exterior wall, to cause inward flexing of said socket exterior wall to reshape said spaced distance to permit said catch means to disengage from said latch means to terminate said mating engagement thereof.

10. The locking lamp fixture of claim 9, wherein said spaced distance is initially circular; and wherein said spaced distance is reshaped to be elliptical whenever a sufficient force is applied.

11. The locking lamp fixture of claim 10, wherein said latch means comprises a protrusion of said lamp base;

wherein said catch means comprises a protrusion on said socket; and wherein said reshaping of said spaced distance enables said protrusions to extend beyond each's respective opposite mating part to permit said disengaging thereof.

12. The locking lamp fixture of claim 9, wherein said latch means and said catch means are aligned; and wherein said disconnection means is about 90° out of alignment with said aligned latch means and catch means.

13. The locking lamp fixture of claim 9, wherein said disconnection means is positioned on said socket; and wherein said socket has a wall thickness which is reduced slightly in order to allow for greater flexibility relative to said lamp base which has a greater wall thickness.

14. The locking lamp fixture of claim 9, wherein the lamp base has an exterior wall having a top portion with an underside; and vertical stabilizers located on said underside of said top portion of said lamp base exterior wall to prevent lateral movement of the lamp base when inserted into the socket.

15. The locking lamp fixture of claim 9, wherein the lamp base has an inside wall having a bottom portion; and bulb retention ribs located on said bottom portion of the inside wall of the lamp base for preventing a lamp bulb from twisting or rotating in said lamp base.

16. A locking lamp fixture comprising a lamp base for containing a light bulb; said lamp base having an exterior wall and having a top end with a top extended portion, said top extended portion having an internal surface and an external surface;

a socket for holding said lamp base; said socket having an exterior wall and having an interior wall;

said lamp base cooperatively dimensioned and configured to fit within said socket such that said exterior wall of said lamp base contacts said interior wall of said socket and such that there is a spaced distance between said exterior wall of said socket and said internal surface of said top extended portion;

latch means on said internal surface of said top extended portion of said lamp base for extending across said spaced distance toward said exterior wall of said socket;

catch means on said socket exterior wall for extending across said spaced distance for mating engagement with said latch means on said lamp base; and disconnection means on the external surface of said top extended portion of said lamp base capable of reshaping said external surface, whenever a sufficient force is applied to said disconnection means on said external surface, to cause inward flexing of said top extended portion to reshape said spaced distance to permit said catch means to disengage from said latch means to terminate said mating engagement thereof.

17. The locking fixture of claim 16, wherein said spaced distance is initially circular; and wherein said spaced distance is reshaped to be elliptical whenever a sufficient force is applied.

18. The locking lamp fixture of claim 17, wherein said latch means comprises a protrusion of said lamp base;

wherein said catch means comprises a protrusion on said socket; and wherein said reshaping of said spaced distance enables said protrusions to extend beyond each's respective opposite mating part to permit said disengaging thereof.

19. The locking lamp fixture of claim 16, wherein said latch means and said catch means are aligned; and wherein said disconnection means is about 90° out of alignment with said aligned latch means and catch means.

20. The locking lamp fixture of claim 16, wherein the lamp base has an exterior wall having a top portion with an underside; and vertical stabilizers located on said underside of said to portion of said lamp base exterior wall to prevent lateral movement of the lamp base when inserted into the socket.

21. The locking lamp fixture of claim 16, wherein the lamp base has an inside wall having a bottom portion; and bulb retention ribs located on said bottom portion of the inside wall of the lamp base for preventing a lamp bulb from twisting or rotating in said lamp base.

* * * * *